United States Patent [19]

Carbonetti

[11] Patent Number: 4,854,596

[45] Date of Patent: Aug. 8, 1989

[54] TENNIS RACKET WITH ANGULARLY ADJUSTABLE HANDLE AND FIXED ANATOMIC GRIP

[76] Inventor: Italo Carbonetti, 11 Via Prassitele, 00125 AXA Acilia Sud RM, Italy

[21] Appl. No.: 130,316

[22] Filed: Dec. 8, 1987

[30] Foreign Application Priority Data

May 25, 1987 [IT] Italy ..... 47978 A/87

[51] Int. Cl.[4] ..... A63B 49/00; A63B 53/14

[52] U.S. Cl. ..... 273/73 J; 273/81 C

[58] Field of Search ..... 273/73 J, 75, 81 C, 273/81.4

[56] References Cited

U.S. PATENT DOCUMENTS

| | | | |
|---|---|---|---|
| 2,044,567 | 6/1936 | Daday | 273/81 C |
| 2,091,512 | 8/1937 | Marsh | 273/81 C |
| 3,968,965 | 7/1976 | Frenkel et al. | 273/73 J |
| 4,101,125 | 7/1978 | Heath | 273/73 J |
| 4,365,807 | 12/1982 | Melby | 273/81 C |
| 4,671,511 | 6/1987 | Trgsinsky | 273/73 J |
| 4,693,475 | 9/1987 | Keilhau | 273/73 J |

FOREIGN PATENT DOCUMENTS

| | | | |
|---|---|---|---|
| 1396424 | 6/1975 | United Kingdom | 273/73 J |

*Primary Examiner*—Richard C. Pinkham
*Assistant Examiner*—Gary Jackson
*Attorney, Agent, or Firm*—Browdy & Neimark

[57] ABSTRACT

A tennis racket with a handle which can take a number of angular attitude positions all around its axis and a stable anatomic grip on the handle to obtain a correct dynamic position in power strokes and to avoid traumas to the articulation (FIG. 4).

3 Claims, 3 Drawing Sheets

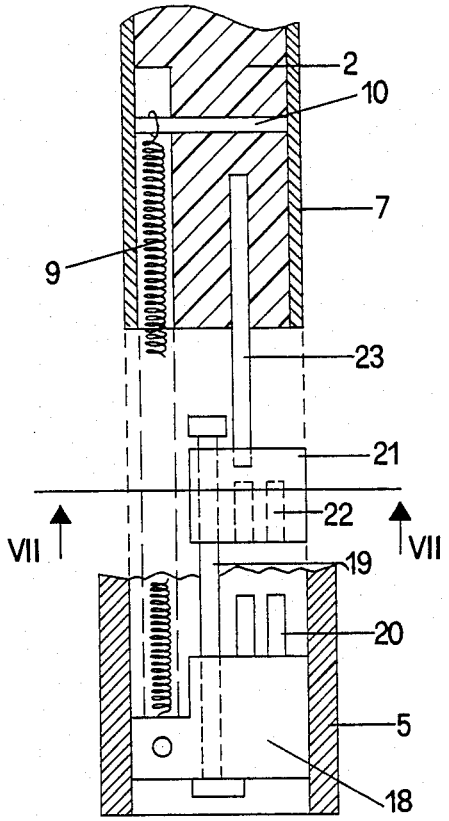
FIG5
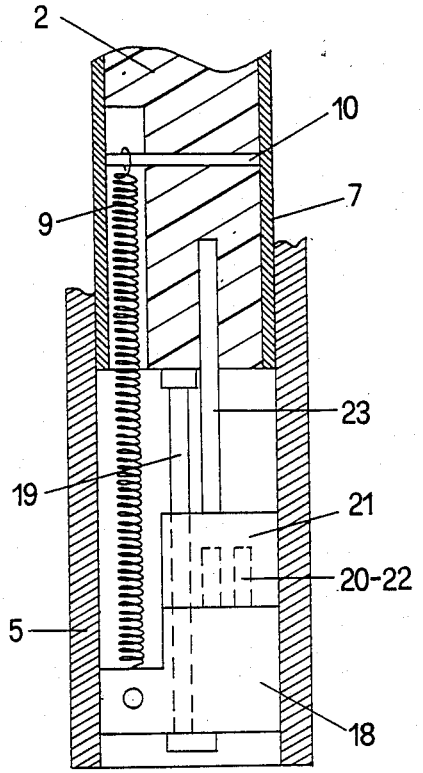
FIG 6
FIG7
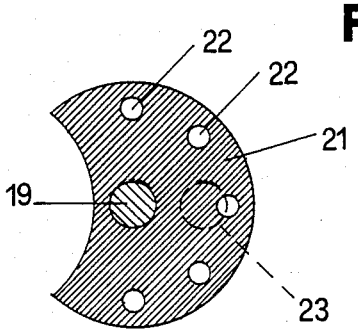

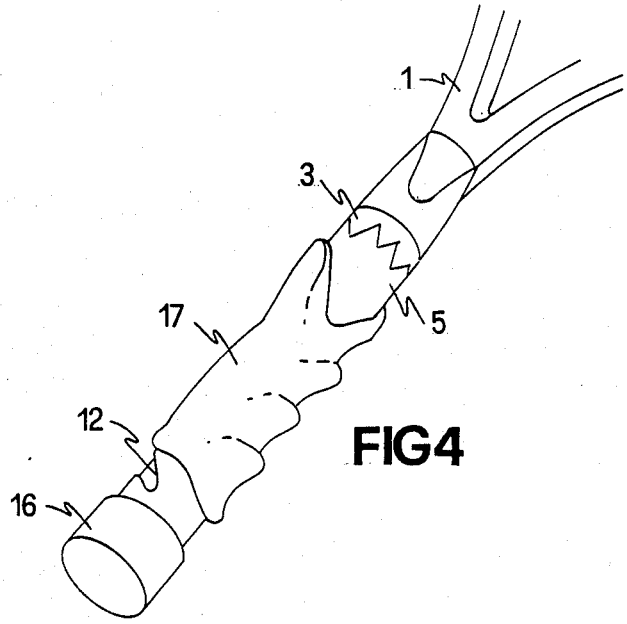
FIG4
FIG8a
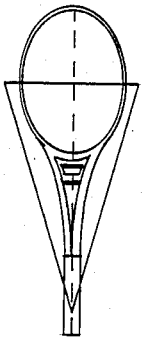
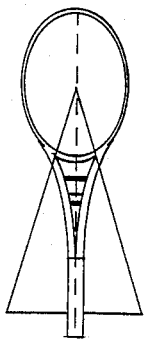
FIG 8b
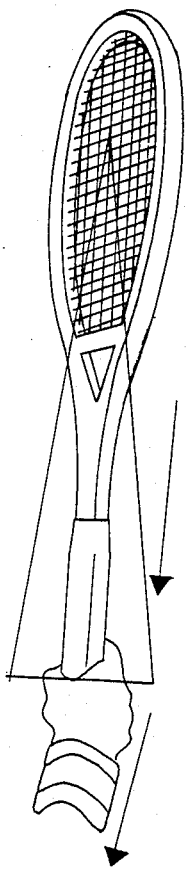
FIG10
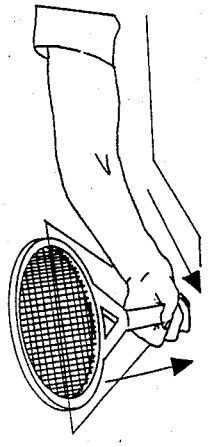
FIG9

TENNIS RACKET WITH ANGULARLY ADJUSTABLE HANDLE AND FIXED ANATOMIC GRIP

DESCRIPTION

BACKGROUND OF THE INVENTION

1. Field of the Invention

The present invention relates to a tennis racket having a handle which can take a number of graduated angular attitudes about its axis, and an anatomic grip on the handle.

2. Description of the Prior Art

In a conventional tennis racket, it is well known that the frame is integral with the handle and the player has to hold the handle to the double purpose of striking the ball and giving the frame of the racket the inclination required in order to obtain the desired direction of the ball.

The ability of the player consists in being able to put the racket in the correct dynamic position with respect to the body and the ball. Apart from the athletic performance by the tennis player, this is the condition for obtaining the best result.

A conventional racket, however, is not made so as to adapt to the anatomic requirements of the aforementioned dynamics. In fact it is well known that those practising this sport may be subjected to injuries to the elbow and shoulder articulations due to an incorrect position when receiving the shock wave in power shots.

This problem not only involves the dynamics of the arm, but generically any limb, when said limb shall strike and throw an object by shock, as occurs, for example, also in the game of soccer.

To overcome these drawbacks, due to the convexity of feet and legs, as well as to an insufficient hold of the racket, soccer and tennis players are often induced to set their limbs in irregular positions, such as a rotation of the legs to strike the ball better with the flatter external part of the foot and adduction and bending of the arms to give power to the musculature in order to avoid a possible rotation of the handle in strokes out of the vertical axis of the racket.

Such balistic advantages are necessarily counterbalanced by dynamic disadvantages on the articulations due to a lack of parallelism in the reaction between the forward and backward proceding waves of energy. The aphysiologic oblique crossing of the fulchra, with the ponderal resistance prevailing on the muscular power, may produce micro- or macro-traumatic alterations in the ligaments and successively traumatize the anatomic structures involved. All traumatology is mainly due to the anomalous attitudes of the limbs in order to obtain a greater precision in final powerful shots, even when considering that a build-up of microtraumas in agonistic activities can predispose the articulations to such events.

SUMMARY OF THE INVENTION

An object of the present invention is the prevention of accidents in the game of tennis, which can be obtained by using the racket of the present invention, establishing moreover a new balistic technique for reducing damages produced by incorrect dynamics.

The present invention relates to a tennis racket having a frame portion and a handle portion for the hold, in which the handle portion comprises in combination: a stud integral with the frame portion of the racket; a tubular sleeve pivotally and telescopically coupled with the stud for assuming a plurality of angular attitudes with respect to the stud about the axis thereof; spring means connecting the stud with the tubular sleeve, which stress the tubular sleeve in the direction towards the frame portion of the racket; means for indexing the angular attitudes of the tubular sleeve; means for securing in a disengageable way the sleeve to the stud; and an anatomic grip integral with said stud to be held by the hand of a tennis player, so that the handle portion of the racket can be made to assume a plurality of angularly shifted attitudes with respect to the grip.

BRIEF DESCRIPTION OF THE DRAWINGS

The invention will be better illustrated referring to the accompanying drawings, wherein:

FIG. 4 is a view of the handle and the grip;

FIG. 5 is an exploded view of a different embodiment of the invention;

FIG. 6 is a cross-section through the axis of the handle of the embodiment shown in FIG. 5;

FIG. 7 is a transversal cross-section along line VII—VII of FIG. 5;

FIGS. 8*a* and 8*b* are a schematic illustration of the balistic dynamics of the racket;

FIGS. 9 and 10 are illustrations of the dynamics;

FIG. 11 shows the anatomic position of the racket according to the prior art; and FIGS. 12, 13 and 14 are illustrations of the anatomic position of the racket according to the invention.

DETAILED DESCRIPTION OF THE EMBODIMENTS

Figure 1:
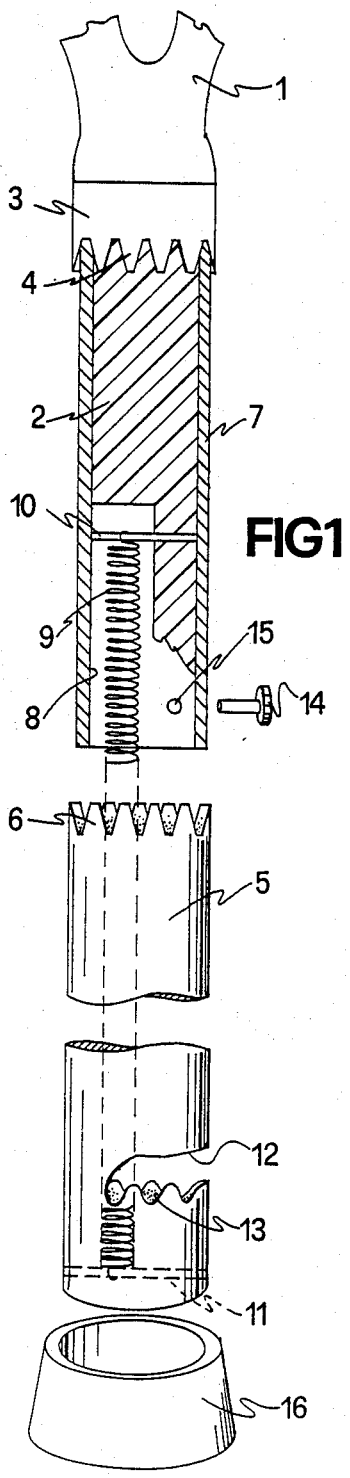
FIG. 1 is an exploded view of the handle portion of the racket.

The elements forming the handle of the racket according to the invention are shown in detail in a first embodiment illustrated in FIG. 1.

The racket comprises a strung frame portion and a handle portion, the strung frame 1 being partially shown in FIG. 1. Integral with the frame 1 is a stud 2 which can be made of the same material as that of which the frame is formed, for example a synthetic resin, particularly a graphitic resin. A crown 3 provided with teeth 4 is integral with the upper part of the stud 2 and can be made of a metallic material or a synthetic resin material. A tubular sleeve 5, the upper part of which is provided with a complementary toothed conformation 6, is telescopically coupled to the stud 2 and is capable of turning about the axis thereof, as well as of sliding in a longitudinal direction along the same axis. In the rest position, the teeth 6 of the sleeve 5 are engaged with the teeth 4 of the crown 3 (see FIG. 2), so that in this position the sleeve 5 is effectively integral with the stud 2.

The sleeve 5 can be manufactured with a metallic material or other material, such as a synthetic resin.

For protection of the stud 2 and for reducing friction to a minimum, the stud 2 can be coated with a covering 7 made of the same material as the tubular sleeve 5 or another material.

Figure 2:
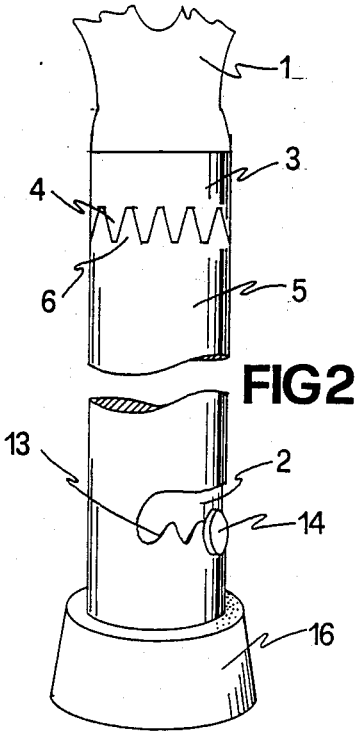
FIG. 2 shows the handle in one of the attitude positions.

The stud 2 has an inner cavity 8 in which a coil spring 9 is housed which is secured to a support 10 integral with the stud 2 and a support 11 integral with the sleeve 5. In this embodiment the spring 9 operates by tension to stress the sleeve 5 so that it remains in the rest position engaged with the crown 3, as shown in FIG. 2.

The sleeve 5, in its lower part, is provided with a slot 12 having a plurality of indents 13 for engagement with an indexing pin 14 secured in a fixed position to the stud 2 through a hole 15.

The sleeve can be provided at its lower end with a base 16 which can be glued thereto by usual adhesives.

A feature of the present invention is that on the tubular sleeve 5 an anatomic grip 17 is applied (FIG. 4), which is gripped by the player in a stable manner. The grip avoids a turning of the racket handle in the case of the ball striking the strung frame off-center and it permits a higher consistency of precision. More-over, as hereinafter described, the grip 14 enables the racket to be maintained in a correct position with respect to the arm and to this end it is provided with a thumb bearing 18 for inducing the thumb to remain positioned along the axis of the handle.

From the foregoing, it will be understood that the handle with its stable grip can be turned about the axis of the stud 2, so that between the grip 17 and the strung frame 1 different angular attitudes of the frame 1 can be obtained.

Figure 3:
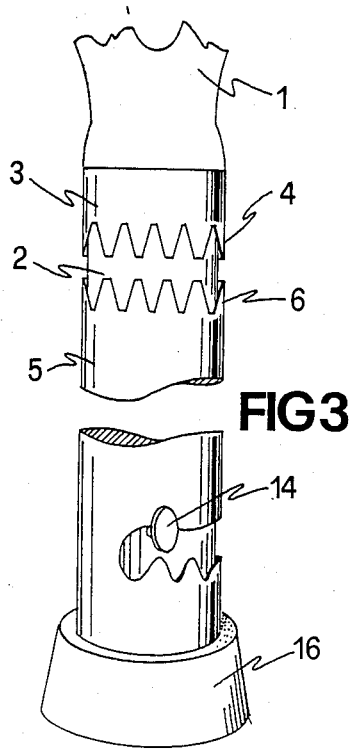
FIG. 3 shows the handle while the attitude position is changed.

FIG. 3, in which the grip is not shown for the sake of clarity, shows that by pulling the sleeve 5 against the action of the spring 3, the teeth 4 of the crown 3 and the teeth 6 of the sleeve 5 are disengaged and at the same time the pin 14 is disengaged from the indent 13 in which it was seated. The sleeve 4 can consequently be turned by a certain angle and, when it is released, the teeth will be engaged again and the indexing pin 14 will be seated in a different indent 13, as shown in the position of FIG. 2.

This change in the attitude of the frame with respect to the grip can be obtained in a fraction of a second when the tennis player is sufficiently trained. It is well known that at present tennis players change the angulation of the racket with respect to the hand holding the racket, depending on the type of stroke, such as forehand drive, backhand drive, service. This change is obtained, according to the present invention, by the above described mechanism, with the advantage that hand always holds the grip correctly.

The grip 17 can be made of synthetic resin, being secured to the sleeve 5 in various manners, in particular by providing notches on the sleeve for attachment by the resin. In FIGS. 5 to 7 a second embodiment of the invention is illustrated, having the advantage of not showing to the sight the pivotal mechanism of the handle and the grip.

Elements similar to those shown in FIGS. 1 to 3, are indicated with the same reference numerals, for the sake of brevity.

A tubular sleeve 5 has the same function as that shown in FIGS. 1 to 3, and it is realized substantially in the same way.

Inside the sleeve 5, not visible from outside, a member 18 integral with an elongated pivot 19 is rigidly secured. The member 18 has on its upper face a plurality of pins 20, having the same function as the indents 13 of the embodiment of FIG. 1. The member 18 is stressed by the spring 9 towards the stud 2 of the handle.

With the pivot 19, moreover, a fixed member 21 is pivotally and slidingly engaged, which is provided on its lower face with cavities 22 for receiving the pins 20 of the turnable member 18.

The fixed member 21 is rigidly connected to the stud 2 of the handle by means of a securing bar 23 rigidly integral with the stud 2. A cross-section of the fixed element 21 is shown on FIG. 7.

In the operating position, the turnable member 18 and the fixed member 21 are substantially integral one with the other in view of the engagement of pins 20 and cavities 22.

In order to change the relative angular position of the handle with respect to the racket, in the same way as shown in FIGS. 1 to 3, the tubular sleeve 5 is pulled down extending the spring 9 and freeing the pins from the cavities 22. The sleeve is turned, and the pins 20 are shifted to engage the cavities 22 angularly offset with respect to the starting position.

Obviously the pins may be secured to the fixed member and the cavities provided in the turnable member.

The advantage of the present invention from the dynamic-balistic point of view is schematically illustrated in FIG. 8, where the base of an isosceles triangle represents the static stability of the support, whereas the opposite vertex represents instability and thus a possible inaccuracy or inefficiency of strokes out of the vertical axis of the triangle. Therefore FIG. 8(*a*) represents a conventional racket incorrectly held, in which the stability is on the side of the racket receiving the shock, whereas the instability resides in the hold. On the contrary, FIG. 8(*b*) represents the principle on which the present invention is based, in which the stability resides in the handle, which can control in this way the strokes received on the strings of the racket.

From the point of view of the anatomic dynamics, this effect can be better observed in FIGS. 9 and 10. An incorrect attitude of the racket with respect to the arm is illustrated in FIG. 9. In this situation, the shock force applied to the strung frame has a component transversal to the arm. This condition produces a stress in the arm with a shear component which affects in an anatomically and dynamically damaging way the articulations of elbow and shoulder. The repeated effect of this shear stress may produce damages to said articulations.

In FIG. 10 conversely an anatomically and dynamically correct position of the racket with respect to the arm is illustrated, in which the shock force on the racket and the shock wave rebounding along the arm musculature, are directed in the proper direction longitudinally to the arm.

In FIGS. 9 and 10 the triangle shown in FIG. 8 is also illustrated, wherein its symbolic representation appears more clearly.

Referring to FIGS. 11 to 14, the position of the hand with respect to the handle of the racket is illustrated in greater detail. With respect to the axis of the arm, the racket can be held in a wide angulation which is indicated starting from 0° from the inner part of the hand, 90° perpendicularly to the axis of the arm and 180° on the axis of the arm on the external part of the hand. The rotation of the hand can cause the racket to assume an angulation between 180° and about 45°. The usual conventional position of the racket is about 125° (FIG. 11).

On the basis of the above mentioned considerations, according to the present invention, the axis of the racket handle is made to range within an ideal angulation of from 155° to 180° (FIGS. 12 to 14).

This is made possible by the stable grip on the handle, which has to be held in a correct way practically with an angulation within very restricted limits.

In order to change the attitude of the strung frame according to the various conditions of the game (forehand, backhand, smash and so on), the angular set of the handle with respect to the frame is acted upon, by means of the device of the present invention as previously described.

Tennis players are already used, while waiting to receive the reply shot of the opponent, to holding the handle with the right hand, the racket pointing forward, while the left hand is placed on the joining point between the handle and the frame. This position is suitable for turning the frame by a certain angle about the axis of the handle, depending on the stroke intended to be given to the arriving ball. With the racket of the invention the waiting position remains the same, with the difference that rather than turning the whole racket, the player will turn the frame with respect to the handle by a certain angle, the handle always remaining in the same stable configuration. The turning operation requires a fraction of a second and it does not raise problems when it becomes a usual and automatic movement.

As already previously described, the angular turning of the handle with respect to the frame is made easier by seating the pin 14 in an indent 13 of the slot 12 (FIGS. 1 to 3), or pins 20 into cavities 22 (FIGS. 5 to 7). To this end, as an example, a plurality of indents or pins respectively may be made such that each indent or pin represents an angular turning step of the frame by 45°. As a further example, three indents enabling a total attitude turning of 90° are considered sufficient for using the racket.

The present invention offers the possibility of manufacturing the same racket for use by both the right and the left hand, in that the slot 12 can comprise the same number of indents in one and the other direction, thus making the racket suitable to be used by either hand.

Summarizing the advantages of the present invention, the anatomic grip, the angulation on about 155° and the turning of the strung frame obtained with the mechanism inside the racket handle, represent a technical progress for tennis with a decrease of the time required for the game, which very often comes to an end through fatigue rather than athletic merit of the players. The invention does not modify the game already established in the conventional art, it rather enhances the agonistic values after a short training.

The stability of the handle, obtained by applying through a cold treatment an acrylic resin on a metal tube, assumes a balistic importance, while the forward inclination of the racket at 155° rather than 110°–125° as at present, assumes an importance in dynamic stability for aligning the rebounding energy waves to the axis of the arm. Therefore the rebound is made as parallel as possible to the anatomic axis so as to obtain a passage of the rebound along the structures and a physiologic damping by the muscles opposing the dynamic rebound, with no articular traumas.

The turning of the frame, consequent to an immovable grip, has a decisive importance for intentionally directed and powerful strokes, in accordance with the requirements and possibilities of the game.

While the invention has been described in considerable detail, it shall be understood that it can be realized within its scope by resorting to equivalent embodiments.

I claim:

1. In a tennis racket having a strung frame portion and a handle portion, said handle portion being formed with a stud integral with said frame portion of the racket, a tubular sleeve pivotally and telescopically engaged with said stud to assume a plurality of angular attitudes with respect to said stud about the axis thereof, spring means connecting said stud and said tubular sleeve which stress said tubular sleeve in the direction of the frame portion of the racket, means for securing in a disengageable manner the sleeve with respect to said stud, the improvement of means for indexing the angular attitude of the sleeve comprising: a turnable member integrally fixed inside the sleeve and engaged with an end of said spring, said turnable member being provided with first angular set means and a pivot integral therewith; a fixed member integral with said stud and provided with second set means to be engaged with said first set means, said fixed member being pivotally and slidingly coupled to said pivot, and an anatomic grip integral with said sleeve for the hold of a player's hand, so that the frame portion of the racket can be made to assume a plurality of angularly shifted attitudes with respect to the grip.

2. A tennis racket having a strung frame portion and a handle portion, said handle portion comprising:

a stud integral with said frame portion of the racket; a tubular sleeve pivotally and telescopically engaged with said stud to assume a plurality of angular attitudes with respect to said stud about the axis thereof; spring means connecting said stud and said tubular sleeve which stress said tubular sleeve in the direction of the frame portion of the racket; means for indexing said angular attitudes of the tubular sleeve; means for securing in a disengageable manner the sleeve with respect to said stud; and an anatomic grip integral with said sleeve for the hold of a player's hand, so that the frame portion of the racket can be made to assume a plurality of angularly shifted attitudes with respect to the grip;

said spring means being formed with a tensioned coil spring placed within a cavity of said stud and secured to supports integral with said stud and the sleeve respectively;

said means for indexing said angular attitudes being symmetric with respect to a central position, so as to make said angular attitudes suitable for both the right and the left hand of the player, said means for indexing said angular attitudes being arranged to graduate the angular attitudes by 45° steps;

said means for securing in a disengageable manner the sleeve to the stud comprising a toothed crown fixed to the stud and a complementary toothed conformation fixed to the sleeve, the engagement of said teeth inhibiting the turning of the sleeve with respect to the stud, and a sliding movement of the sleeve with respect to the stud disengaging the teeth and enabling a turning of the sleeve with respect to the stud;

said means for indexing the angular attitude of the sleeve further comprising: a turnable member integrally fixed inside the sleeve and engaged with an end of said spring, said turnable member being provided with first angular set means and a pivot integral therewith; a fixed member integral with said stud and provided with second set means to be engaged with said first set means, said fixed member being pivotally and slidingly coupled to said pivot.

3. A racket according to claim 1, in which said first set means are pins fixed to said turnable member and said second set means are cavities provided in the fixed member.

* * * * *